US008858067B2

(12) United States Patent
Noishiki et al.

(10) Patent No.: US 8,858,067 B2
(45) Date of Patent: Oct. 14, 2014

(54) FLOW CHANNEL STRUCTURE

(75) Inventors: Koji Noishiki, Takasago (JP); Makoto Nishimura, Kobe (JP); Takeshi Yamashita, Kobe (JP); Daisuke Nishikawa, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 142 days.

(21) Appl. No.: 13/296,810

(22) Filed: Nov. 15, 2011

(65) Prior Publication Data

US 2012/0138176 A1 Jun. 7, 2012

(30) Foreign Application Priority Data

Dec. 7, 2010 (JP) ..... 2010-272472

(51) Int. Cl.
*B01F 5/06* (2006.01)
*B01F 13/00* (2006.01)

(52) U.S. Cl.
CPC ..... *B01F 13/0059* (2013.01); *B01F 5/065* (2013.01)
USPC ..... 366/340; 366/181.5; 366/336

(58) Field of Classification Search
CPC ..... B01F 5/0641–5/645
USPC ..... 366/181.5, 336–338, 340–341, DIG. 3
See application file for complete search history.

(56) References Cited

U.S. PATENT DOCUMENTS 6,305,834 B1 * 10/2001 Schubert et al. ..... 366/144
6,890,093 B2 * 5/2005 Karp et al. ..... 366/336
7,708,950 B2 * 5/2010 Yamada et al. ..... 422/504
7,909,502 B2 * 3/2011 Ehrfeld et al. ..... 366/340
8,142,741 B2 * 3/2012 Yoshida et al. ..... 422/602
8,192,703 B2 * 6/2012 Ban et al. ..... 422/603

(Continued)

FOREIGN PATENT DOCUMENTS

JP 2004-317439 11/2004
JP 2005-127864 5/2005

(Continued)

OTHER PUBLICATIONS

Office Action issued on Mar. 19, 2013 in the corresponding Japanese Patent Application No. 2010-272472 (with English Translation).

(Continued)

*Primary Examiner* — David Sorkin
*Assistant Examiner* — Abbas Rashid
(74) *Attorney, Agent, or Firm* — Oblon, Spivak, McClelland, Maier & Neustadt, L.L.P.

(57) ABSTRACT

A flow channel structure that includes a first inlet path for a first fluid, a second inlet path for a second fluid, a merging portion that merges, in the thickness direction of a substrate, the first fluid and the second fluid, a first merged fluid channel in which both fluids merged in the merging portion flow along a top surface of the substrate, a flow direction altering portion that causes the flow direction of the fluid flowing through the first merged fluid channel to change from the top surface side of the substrate towards the back surface side thereof, and a second merged fluid channel for changing the flow direction of this fluid to flow to the downstream side so that the fluid flowing from the first merged fluid channel through the flow direction altering portion flows along the back surface of the substrate.

5 Claims, 8 Drawing Sheets

(56) References Cited

U.S. PATENT DOCUMENTS

| | | | | |
|---|---|---|---|---|
| 8,673,243 | B2 * | 3/2014 | Noishiki et al. | 422/602 |
| 2003/0082079 | A1 * | 5/2003 | Sawano | 422/100 |
| 2004/0265184 | A1 | 12/2004 | Matsuda et al. | |
| 2006/0275184 | A1 * | 12/2006 | Furukawa et al. | 422/129 |
| 2010/0178213 | A1 | 7/2010 | Ban et al. | |
| 2010/0178221 | A1 * | 7/2010 | Yoshida et al. | 422/236 |
| 2011/0266498 | A1 * | 11/2011 | Noishiki et al. | 252/183.11 |
| 2011/0268616 | A1 * | 11/2011 | Noishiki et al. | 422/129 |

FOREIGN PATENT DOCUMENTS

| | | | | |
|---|---|---|---|---|
| JP | 2006-130502 | | 5/2006 | |
| JP | 2008-168173 | | 7/2008 | |
| JP | 2010-162427 | | 7/2010 | |
| WO | WO/2010082287 | * | 7/2010 | B01J 19/00 |

OTHER PUBLICATIONS

U.S. Appl. No. 13/363,635, filed Feb. 1, 2012, Noishiki et al.

* cited by examiner

FLOW CHANNEL STRUCTURE

BACKGROUND OF THE INVENTION

1. Field of the Invention:

The present invention relates to a flow channel structure.

2. Description of the Related Art:

Conventionally, flow channel structures have been known as a means for causing a plurality of fluids to mix and bring about interaction between these fluids. Japanese Patent Application Publication No. 2005-127864 provides an example of such a flow channel structure.

The flow channel structure illustrated therein is used as a micro-mixing devise to cause two fluids to mix together inside of fine channels. The fine channels possessed by this mixing device include two inlet channels, and one outlet channel joined to an end on the downstream side of these inlet channels. At a position of the outlet channel in the vicinity of a connecting portion with the inlet channels, a projection is provided that projects from an inside surface of this outlet channel, whereby the outlet channel is narrowed. Then, a fluid is introduced to each of the inlet channels, and the fluids introduced to the respective inlet channels are merged together by flowing to the downstream side and entering the outlet channel. The fluids having merged by flowing into the outlet channel generate eddies immediately before and immediately after passing the portion at which the width of the outlet channel is narrowed by the projection, as a result of which, mixing of the fluids is promoted.

However, the channel diameter is small with the flow channel structure described in the above-mentioned patent publication, and this channel diameter of the fine channels for which the pressure loss is large by nature is further narrowed by the projection; therefore, the pressure loss inside of this channel increases significantly.

SUMMARY OF THE INVENTION

The present invention has been made in order to solve the above-mentioned problems, and has an object of providing a flow channel structure that can avoid a significant increase in pressure loss inside of a flow channel, while also promoting the mixing of fluids merged in this flow channel.

In order to achieve the above-mentioned object, a flow channel structure according to the present invention having a flow channel for causing a first fluid and a second fluid to flow so as to mix together inside thereof, the flow channel structure includes: a substrate having a top surface and a back surface that faces an opposite direction to the top surface; a first sealing plate joined to the top surface of the substrate; a second sealing plate joined to the back surface of the substrate, in which: a first groove extending in a specific direction is formed in the top surface of the substrate, a second groove extending in a specific direction and having an end overlapping the first groove when viewed from a direction perpendicular to the top surface of the substrate, and a third groove extending in a specific direction and having an end overlapping the first groove when viewed from a direction perpendicular to the top surface of the substrate, at a position separated from the end of the second groove overlapping the first groove, are formed in the back surface of the substrate, a first hole, which penetrates the substrate from the top surface thereof to the back surface to communicate the second groove and the first groove positioned on a top side of the second groove, is formed at a location in the substrate at which an end of the second groove on a third groove side thereof is positioned, a second hole, which penetrates the substrate from the top surface thereof to the back surface to communicate the third groove and the first groove positioned on a top side of the third groove, is formed at a location in the substrate at which an end of the third groove on a second groove side thereof is positioned, the first sealing plate is joined to the top surface of the substrate so as to seal an opening of the first groove on a top surface side thereof, the second sealing plate is joined to the back surface of the substrate so as to seal an opening of the second groove on a back surface side thereof and an opening of the third groove on a back surface side thereof, in which the flow channel is configured by a portion of the first groove positioned on an opposite side relative to the first hole than a side on which the second hole is formed, the flow channel including: a first inlet path into which the first fluid is introduced; a second inlet path into which the second fluid is introduced, configured by a portion of the second groove other than a portion in which the first hole is formed; a merging portion configured by the first hole and portions of the first groove and the second groove that are in communication via the first hole, and merging the first fluid flowing through the first inlet path and the second fluid flowing through the second inlet path in a thickness direction of the substrate; a first merged fluid channel that is configured by a portion of the first groove positioned between the first hole and the second hole, and through which both the first fluid and the second fluid merged in the merging portion flow along the top surface of the substrate; a flow direction altering portion that is configured by the second hole and portions of the first groove and the third groove that are in communication via the second hole, and causes a flow direction of the fluid flowing through the first merged fluid channel to change from a top surface side of the substrate towards a back surface side thereof; and a second merged fluid channel that is configured by a portion of the third groove extending to an opposite side relative to the second hole than a side on which the second groove is formed, and changes the flow direction of the fluid to flow to a downstream side so that the fluid flowing from the first merged fluid channel through the flow direction altering portion flows along the back surface of the substrate.

With this flow channel structure, after the mixed fluid of the first fluid and the second fluid mixed by merging in the merging portion flows through the first merged fluid channel along the top surface of the substrate, it flows through the flow direction altering portion from the top surface side of the substrate towards the back surface side thereof, after which it flows through the second merged fluid channel along the back surface of the substrate. Therefore, in the process of the mixed fluid reaching the second merged fluid channel from the first merged fluid channel through the flow direction altering portion with this flow channel structure, the flow direction of this mixed fluid suddenly changes from a direction along the top surface of the substrate to the thickness direction of the substrate, and then further changes suddenly from the thickness direction of the substrate to a direction along the back surface of the substrate. Due to this, disturbance arises in the flow of the mixed fluid in this process, as a result of which, mixing of the first fluid and the second fluid can be promoted. Moreover, with this flow channel structure, since mixing of this mixed fluid is promoted by causing the flow direction of the mixed fluid to suddenly change from a direction along the top surface of the substrate to the thickness direction of the substrate, and further to a direction along the back surface of the substrate, in the portion of the flow channels from the first merged fluid channel to the second merged fluid channel as described above, it is not necessary to attempt to promote the mixing of the fluid by narrowing the channel diameter by a projection as in a conventional flow channel structure, and thus it is possible to avoid a considerable rise in pressure loss in the flow channel.

Furthermore, with this flow channel structure, a portion of the flow channel from the first merged fluid channel through the flow direction altering portion to the second merged fluid channel is formed in a curved shape in the thickness direction of the substrate. As a result, compared to a case of the portion from the first merged fluid channel through the flow direction altering portion to the second merged fluid channel being formed in a curved shape in the same surface of the substrate, it is possible to reduce the width occupied by this portion in a lateral direction of the substrate.

In the above-mentioned flow channel structure, it is preferable for the second groove to extend in parallel with the first groove.

According to this configuration, since the first inlet path and the second inlet path extend in parallel to each other, compared to a case of the first inlet path and second inlet path extending in different directions from each other in a lateral direction of the substrate, it is possible to reduce the width in the flow channel structure occupied by the first inlet path and the second inlet path of the flow channel in the lateral direction of the substrate.

In this case, it is preferable for one among a portion of the first groove configuring the first inlet path and a portion of the second groove configuring the second inlet path to be provided within a span of the width of the other one thereof, when viewed from a direction perpendicular to the top surface of the substrate.

According to this configuration, since one among the first inlet path and the second inlet path is disposed within the span of the width of the other one, compared to a case of one among the two inlet paths being disposed so as to protrude in the width direction relative to the other one, it is possible to further reduce the width occupied by both of the inlet paths in the lateral direction of the substrate.

In the above-mentioned flow channel structure, it is preferable for the third groove to extend in parallel to the first groove.

According to this configuration, since the second merged fluid channel extends in parallel with the first merged fluid channel, compared to a case of the second merged fluid channel and the first merged fluid channel extending in different directions from each other, it is possible to reduce the width in the flow channel structure occupied by the portion of the flow channel from the first merged fluid channel to the second merged fluid channel in the lateral direction of the substrate.

It is preferable for the above-mentioned flow channel structure to include a plurality of the flow channels; for the first grooves respectively configuring the first inlet path and the first merged fluid channel of each of the flow channels to be disposed to be aligned in parallel with each other at the top surface of the substrate; for the second grooves respectively configuring the second inlet path of each of the flow channels to be disposed to be aligned in parallel with each other at the back surface of the substrate; and for the third grooves respectively configuring the second merged fluid channel of each of the flow channels to be disposed to be aligned in parallel with each at the back surface of the substrate.

According to this configuration, it is possible to cause the first fluid and the second fluid to merge in each of the plurality of flow channels to carry out a process of mixing these fluids, whereby the efficiency of the mixing process of fluid for the overall flow channel structure can be improved. Moreover, according to this configuration, each of the first inlet paths, second inlet paths, first merged fluid channels and second merged fluid channels of the flow channels are disposed in parallel to each other, respectively; therefore, compared to a case of these channels being disposed so as to extend in different directions from each other, it is possible to reduce the intervals between the respective flow channels. As a result, with this configuration, the plurality of flow channels can be densely arranged, even in a case of an increase in capacity of the flow channel structure being demanded; therefore, the flow channel structure can be made more compact, while being able to realize an increase in the capacity of the flow channel structure. Therefore, with this configuration, it is possible to improve the efficiency of the mixing process of the fluids in the overall flow channel structure, while making the flow channel structure compact.

As explained in the foregoing, according to the present invention, a flow channel structure can be provided that can avoid a significant increase in pressure loss inside a flow channel, while also promoting the mixing of fluids merged in this flow channel.

DESCRIPTION OF THE PREFERRED EMBODIMENTS

Figure 1:
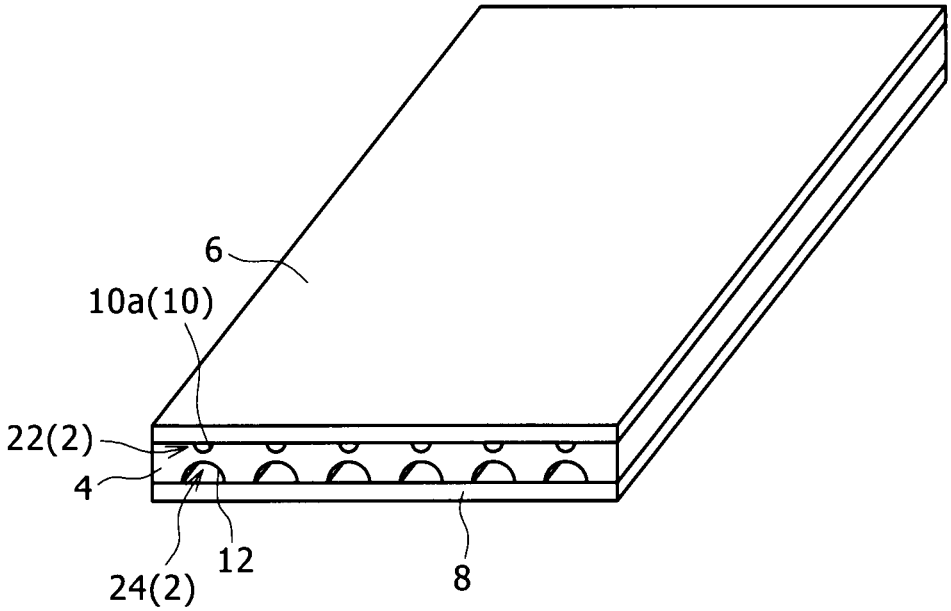
FIG. 1 is a perspective view showing a flow channel structure according to an embodiment of the present invention.

Hereinafter, an embodiment of the present invention will be explained while referring to the drawings.

First, the configuration of a flow channel structure according to one embodiment of the present invention will be explained while referring to FIGS. 1 to 7.

The flow channel structure according to the present embodiment is a structure for causing a plurality of fluids to circulate so as to mix with each other. This flow channel structure has a plurality of fine flow paths 2 for causing a first fluid and a second fluid to circulate so that these fluids mix with each other.

More specifically, this flow channel structure is used in a micro reactor (reaction device), heat exchanger, extraction apparatus, absorption apparatus, mixing device for emulsification, or the like, for example.

In a case of this flow channel structure being used in a micro reactor (reaction device), two fluids constituting reactants that can react with each other are mixed by flowing through the flow channels 2 inside of the flow channel structure, whereby a chemical reaction between these fluids occurs to obtain a desired reaction product. In this case, the first fluid and the second fluid may both be liquids, both may be gases, or one may be a liquid and the other may be a gas.

In addition, in a case of this flow channel structure being used in a heat exchanger, the fluid flowing through the flow channels 2 inside the flow channel structure is gas-liquid two-phase flow, liquid single-phase flow, or gas single-phase flow. When the fluid flowing through the flow channels 2 is gas-liquid two-phase flow, i.e. when one among the first fluid and the second fluid is a gas and the other one is a liquid, uniform evaporation or uniform condensation is desired to be performed. Uniform heat transfer is carried out with little drift from the two fluids being mixed by flowing through the flow channels 2 inside the flow channel structure. In addition, when a fluid being allowed to flow through the flow channels 2 is single-phase flow, i.e. in a case of the first fluid and the second fluid both being liquids or both being gases, the promotion of heat transfer between both fluids is anticipated by the active renewal in the contact interface between the first fluid and the second fluid.

Furthermore, when this flow channel structure is used in an extraction apparatus, one fluid containing an extraction object and the other fluid that is an extraction medium are mixed by flowing through the flow channels 2 inside of the flow channel structure, whereby the extraction object is extracted from the one fluid to the other fluid. In this case, the first fluid and the second fluid are both liquids.

In addition, in a case of this flow channel structure being used in an absorption apparatus, one fluid containing an absorption object and the other fluid that is an absorbing medium flow through the flow channels 2 in the flow channel structure so as to actively renew the contact interface of these two fluids, whereby the absorption object is absorbed from the one fluid to the other fluid. In this case, the first fluid and the second fluid are a gas or liquid.

Furthermore, in a case of this flow channel structure being used in a mixing device for emulsification, two fluids are mixed by flowing through the flow channels 2 inside the flow channel structure, whereby one fluid is emulsified. In this case, the first fluid and the second fluid are both liquids.

The flow channel structure includes a substrate 4, a first sealing plate 6, and a second sealing plate 8, as shown in FIG. 1. This substrate 4, first sealing plate 6, and second sealing plate 8 are respectively formed by rectangular flat plates.

Figure 2:
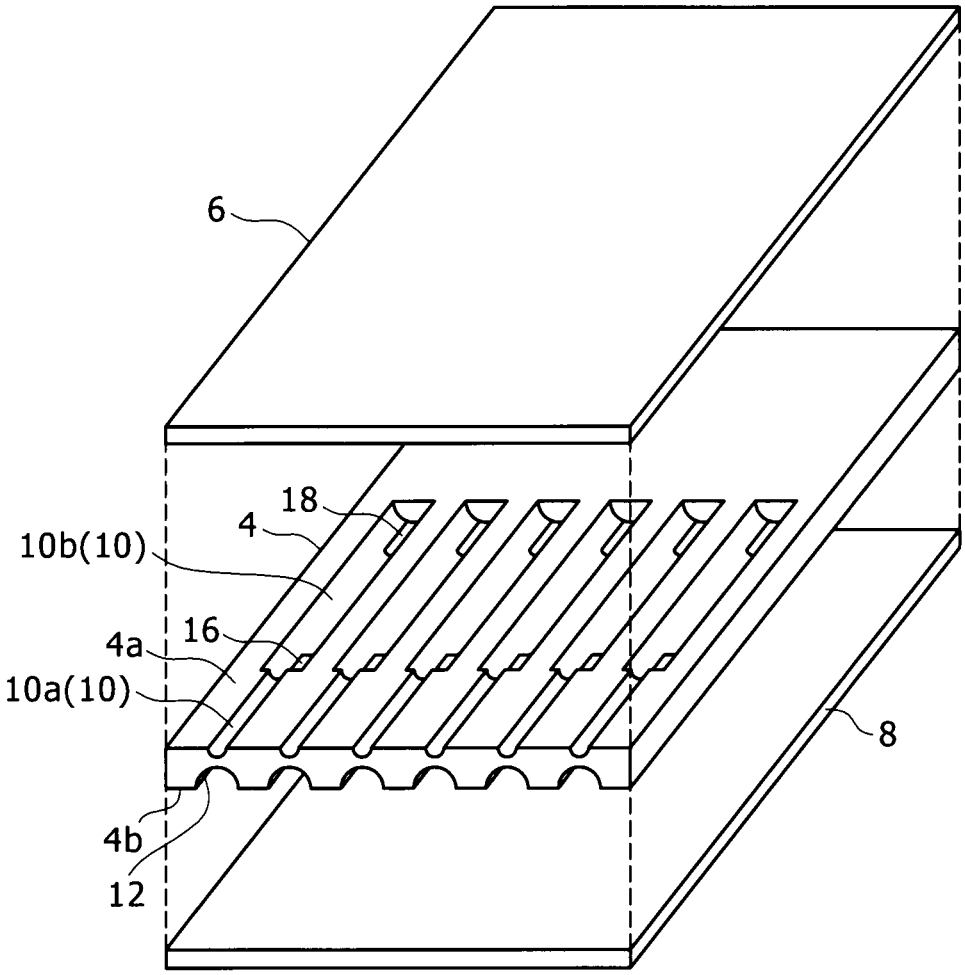
FIG. 2 is an exploded perspective view of the flow channel structure shown in FIG. 1.

As shown in FIG. 2, the substrate 4 has a top surface 4*a* facing one side in the thickness direction thereof, and a back surface 4*b* facing the opposite direction to this top surface 4*a*. In a state covering the top surface 4*a* of the substrate 4, the first sealing plate 6 is joined to this top surface 4*a*. In a state covering the back surface 4*b* of the substrate 4, the second sealing plate 8 is joined to this back surface 4*b*. In other words, the flow channel structure is formed by this substrate 4 and both sealing plates 6 and 8 being integrated in a state in which the substrate 4 is inserted between the first sealing plate 6 and the second sealing plate 8.

A plurality of first grooves 10 is formed by etching in the top surface 4*a* of the substrate 4. This plurality of first grooves 10 is arranged so as to linearly extend in a specified direction and to be aligned in parallel with each other at even intervals, and to each open at the top surface 4*a* of the substrate 4. The first sealing plate 6 is joined to the top surface 4*a* of the substrate 4 so as to seal the openings of the first grooves 10 on the top surface 4*a* side of the substrate 4. Each of the first grooves 10 is composed of a first portion 10*a* and a second portion 10*b* having cross-sectional shapes in a direction perpendicular to the longitudinal direction of the first grooves 10 that differ from each other. This first portion 10*a* and second portion 10*b* respectively have a predetermined length and specific depth, and are disposed to extend along the longitudinal direction of the first grooves 10 and to be aligned in the longitudinal direction thereof.

Figure 4:
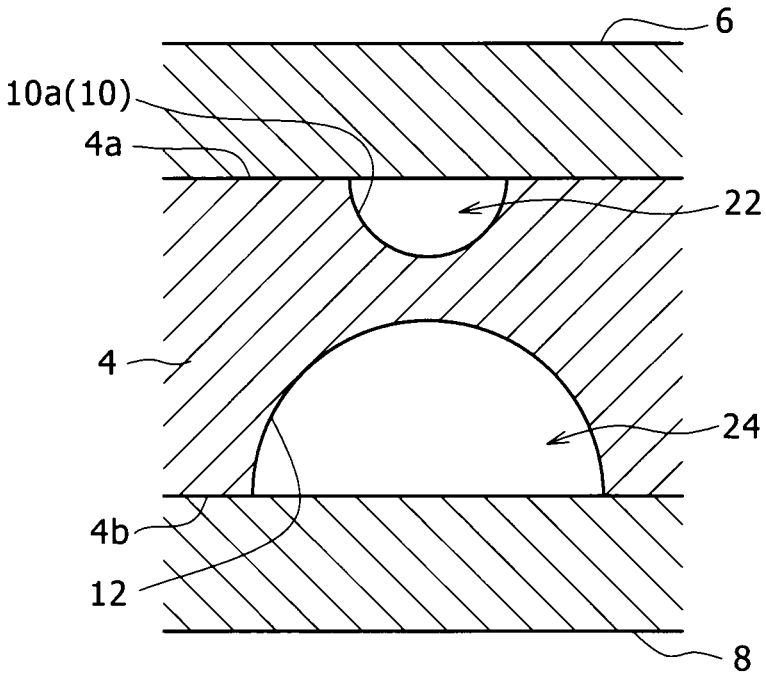
FIG. 4 is a cross-sectional view along the line IV-IV of the flow channel structure shown in FIG. 1.

As shown in FIG. 4, the first portion 10*a* has an inner surface that is formed so that the cross section in a direction perpendicular to the longitudinal direction of the first portion 10*a* makes an arc shape.

Figure 6:
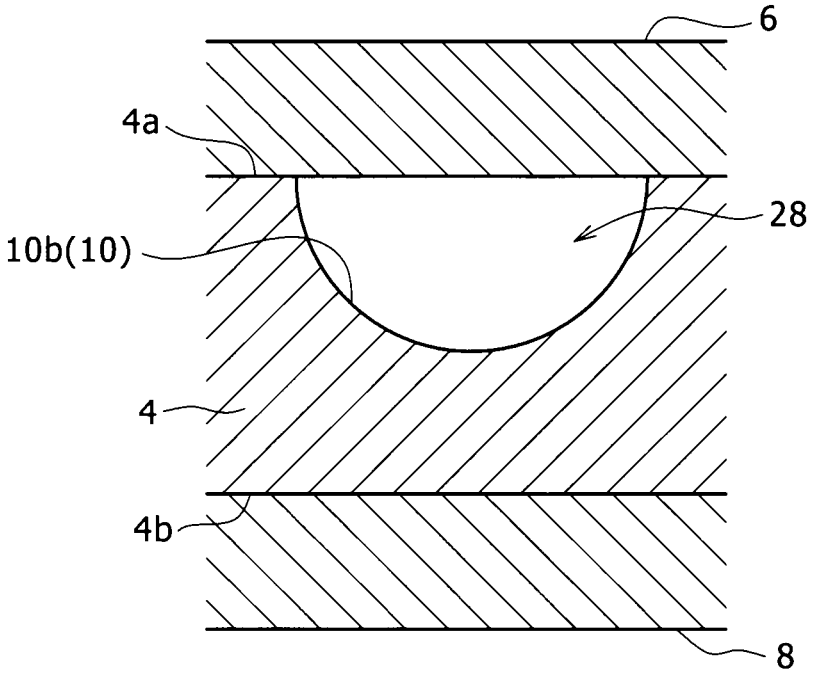
FIG. 6 is a cross-sectional view along the line VI-VI of the flow channel structure shown in FIG. 1.

As shown in FIG. 6, the second portion 10*b* has an inner surface formed so that the cross section in a direction perpendicular to the longitudinal direction of the second portion 10*b* makes an arc shape, and has a depth and width larger than those of the first portion 10*a*, respectively. More specifically, the arc-shaped cross section of the inner surface of the second portion 10*b* has a larger radius than the radius of the arc-shaped cross section of the inner surface of the first portion 10*a*.

A plurality of second grooves 12 extending in a specific direction (refer to FIG. 2), and a plurality of third grooves 14 disposed to be separated from each of these second grooves 12 in the longitudinal direction of each of the second grooves 12 (refer to FIG. 3) are formed by etching in the back surface 4*b* of the substrate 4.

Each of the second grooves 12 is disposed on the back side of the first portion 10*a* of each of the first grooves 10 so as to extend in parallel with the respective first portions 10*a*. In other words, the first portion 10*a* of the first groove 10 and the second groove 12 are disposed in parallel to each other to be aligned in the thickness direction of the substrate 4. In addition, each of the second grooves 12 is disposed so as to be aligned in parallel to each other at even intervals on the back surface 4*b* of the substrate 4, and respectively open on the back surface 4*b* of the substrate 4. An end of each of the second grooves 12 on a third groove 14 side thereof is disposed so as to overlap and end of the second portion 10*b* of the first groove 10 on a first portion 10*a* side thereof locating on the top side of this second groove 12, when viewed from a direction perpendicular to the top surface 4*a* and back surface 4*b* of the substrate 4. In addition, as shown in FIG. 4, each of the second grooves 12 has an inner surface formed so that the cross section in a direction perpendicular to the longitudinal direction of the second groove 12 makes an arc shape. This second groove 12 has a width and depth larger than those of the first portion 10*a* of the first groove 10, respectively. In other words, the arc-shaped cross section of the inner surface of this second groove 12 has a radius larger than the radius of the arc-shaped cross section of the inner surface of the first portion 10*a*. By each of the second grooves 12 being formed in the above such shape, the first portion 10*a* of the first groove 10 positioned on the top side of this second groove 12 is provided within the span of the width of the second groove 12 when viewed from a direction perpendicular to the top surface 4*a* and back surface 4*b* of the substrate 4.

Each of the third grooves 14 is disposed to be separated from a corresponding second groove 12 in the longitudinal direction of each of the second grooves 12, and extends in the same direction as this corresponding second groove 12. In addition, each of the third grooves 14 extends in parallel with the second portion 10*b* of the first groove 10 positioned on the top side of the third groove 14 (top surface 4*a* side of the substrate 4). Each of the third grooves 14 is disposed so as to have a central position in a width direction match the corresponding second groove 12. In addition, each of the third grooves 14 is disposed so as to be aligned in parallel to each other with even intervals, and respectively open on the back surface 4*b* of the substrate 4. The end of each third groove 14 on a second groove 12 side thereof is disposed so as to overlap with an end of the second portion 10*b* of the first groove 10 on an opposite side than the first portion 10*a*, located on the top side of the third groove 14, when viewed from a direction perpendicular to the top surface 4*a* and back surface 4*b* of the substrate 4. In addition, the third groove 14 has a cross-sectional shape obtained by inverting the cross-sectional shape of the second portion 10*b* of the first groove 10 in the thickness direction of the substrate 4 (refer to FIG. 7).

The second sealing plate 8 is joined to the back surface 4*b* of the substrate 4 so as to seal the openings of the second grooves 12 and the third grooves 14 on the back surface 4*b* side of the substrate 4.

In addition, as shown in FIG. 2, a plurality of first holes 16 and a plurality of second holes 18 are formed in the substrate 4.

Each of the first holes 16 is formed at a location in the substrate 4 at which the end of each second groove 12 on the third groove 14 side thereof is located, respectively. Each of the first holes 16 penetrates the substrate 4 from the top surface 4*a* to the back surface 4*b* in the thickness direction of the substrate 4 to allow the end of each second groove 12 on the third groove 14 side thereof and the end of the second portion 10*b* of the first groove 10 on the first portion 10*a* side thereof located on the top side of the second groove 12 to be in communication. When the second portion 10*b* and the second groove 12 are each formed by etching, the overlapped ends thereof connect in the thickness direction of the substrate 4 due to the sum of the depths of the second portion 10*b* and the second groove 12 that are in communication via the first hole 16 being greater than the thickness of the substrate 4, whereby each of these first holes 16 is formed.

Each of the second holes 18 is formed in the substrate 4 at a location in the substrate 4 at which the end of each third groove 14 on the second groove 12 side thereof is located, respectively. Each of the second holes 18 penetrates the substrate 4 from the top surface 4*a* to the back surface 4*b* in the thickness direction of the substrate 4 to allow the end of each third groove 14 on the second groove 12 side thereof and the end of the second portion 10*b* of the first groove 10 on an opposite side to the first portion 10*a* side thereof located at the top side of the third groove 14 to be in communication. When the second portion 10*b* and the third groove 14 are each formed by etching, the overlapped ends thereof connect in the thickness direction of the substrate 4 due to the sum of the depths of the second portion 10*b* and the third groove 14 that are in communication via the second hole 18 being greater than the thickness of the substrate 4, whereby each of these second holes 18 is formed.

Figure 3:
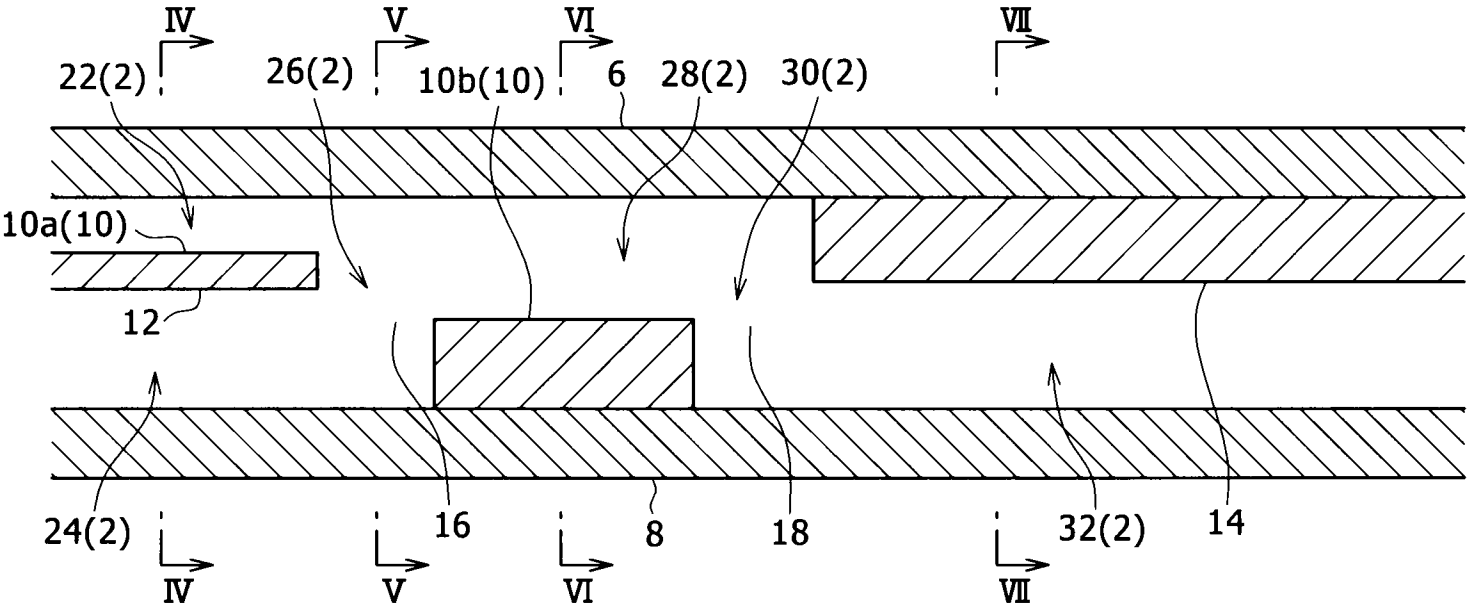
FIG. 3 is a longitudinal sectional view along a longitudinal direction of a flow channel of the flow channel structure shown in FIG. 1.

The plurality of flow channels 2 provided inside the flow channel structure is disposed so as to be aligned in parallel at even intervals in a lateral direction of the substrate 4. As shown in FIG. 3, each of the flow channels 2 has a first inlet path 22, a second inlet path 24, a merging portion 26, a first merged fluid channel 28, a flow direction altering portion 30, and a second merged fluid channel 32.

The first inlet path 22 is a portion into which the first fluid is introduced to flow therein, and extends linearly in a specific direction. The first inlet path 22 is configured by a portion of the first groove 10 at which the opening on the top surface 4*a* side of the substrate 4 is sealed by the first sealing plate 6, the portion being located on an opposite side to the second hole 18 relative to the first hole 16. In other words, the first inlet path 22 is configured by the first portion 10*a* of the first groove 10 at which the opening on the top surface 4*a* side is sealed by the first sealing plate 6. As shown in FIG. 4, the shape of a cross section of this first inlet path 22 in a direction perpendicular to the longitudinal direction makes a semicircle with the portion of the arc shape facing the back surface 4*b* side of the substrate 4.

The second inlet path 24 (refer to FIG. 3) is a portion into which the second fluid is introduced to flow therein. This second inlet path 24 is disposed on the back side of the first inlet path 22 of the flow channel 2, which includes the second inlet path 24, and extends in parallel with this first inlet path 22. In other words, in each of the flow channels 2, the first inlet path 22 and the second inlet path 24 are disposed in parallel to each other to be aligned in the thickness direction of the substrate 4. The second inlet path 24 is configured by a portion of the second groove 12, other than the portion in which the first hole 16 is formed, at which the opening on the back surface 4*b* side of the substrate 4 is sealed by the second sealing plate 8, i.e. a portion of the second groove 12 located on an opposite side to the third groove 14 relative to the first hole 16. As shown in FIG. 4, the shape of the cross section of this second inlet path 24 in a direction perpendicular to the longitudinal direction makes a semicircle in which the portion of an arc shape faces the top surface 4*a* side of the substrate 4. The depth of the second inlet path 24 in the thickness direction of the substrate 4 is larger than the depth of the first inlet path 22 in the same direction. In addition, the width of the second inlet path 24 in a direction perpendicular to the longitudinal direction of the second inlet path 24, which is lateral direction of the substrate 4, is larger than the width of the first inlet path 22 in the direction perpendicular to the longitudinal direction of the first inlet path 22 that is a lateral direction of the substrate 4. By the second inlet path 24 being formed in the above such shape, the first inlet path 22 located at the top surface 4*a* side of the substrate 4 of the second inlet path 24 is provided within the span of the width of the second inlet path 24, when viewed from a direction perpendicular to the top surface 4*a* and back surface 4*b* of the substrate 4. In addition, the first inlet path 22 and the second inlet path 24 of each of the flow channels 2 are disposed so that the central positions in the width directions thereof match.

Figure 5:
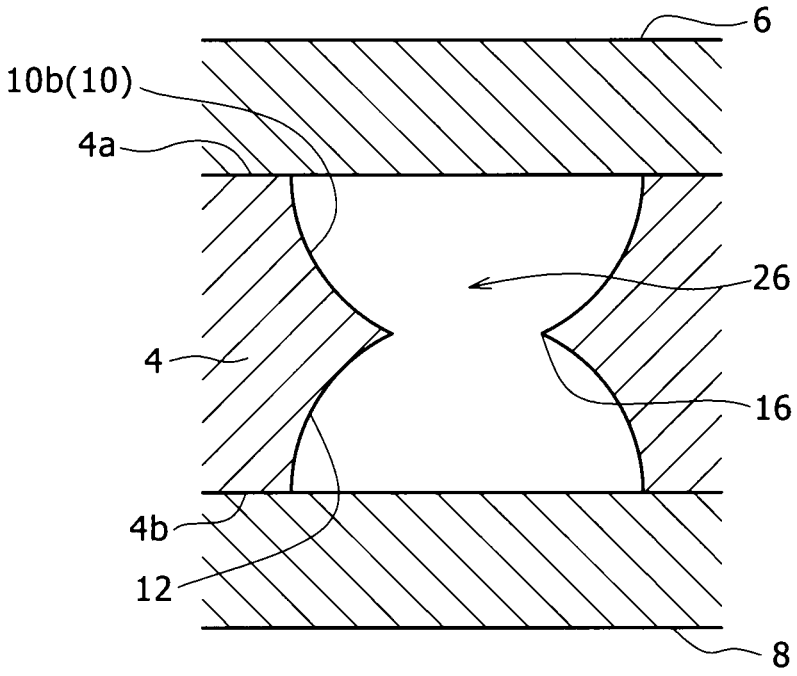
FIG. 5 is a cross-sectional view along the line V-V of the flow channel structure shown in FIG. 1.

The merging portion 26 (refer to FIG. 3) is connected to the downstream sides of the first inlet path 22 and the second inlet path 24, and is a portion for merging the first fluid flowing through the first inlet path 22 and the second fluid flowing through the second inlet path 24 in the thickness direction of the substrate 4. This merging portion 26 is configured from the first hole 16, and portions of the second portion 10*b* of the first groove 10 at which the opening on the top surface 4*a* side of the substrate 4 is sealed by the first sealing plate 6, and of the second groove 12 at which the opening on the back surface 4*b* side of the substrate 4 is sealed by the second sealing plate 8 that are in communication via the first hole 16. As shown in FIG. 5, the cross-sectional shape of the merging portion 26 in a direction perpendicular to extending direction of the flow channel 2 makes a shape such that two semicircles disposed symmetrically to each other in the thickness direction of the substrate 4 are superimposed at portions in the vicinity of the apex thereof.

The first merged fluid channel 28 (refer to FIG. 3) is a portion in which the mixed fluid of the first fluid and the second fluid merged in the merging portion 26 flows along the top surface 4*a* of the substrate 4. The first merged fluid channel 28 is connected to the downstream side of the merging portion 26, and extends in the same direction as the first inlet path 22. This first merged fluid channel 28 is configured by a portion of the second portion 10*b* of the first groove 10, located between the first hole 16 and the second hole 18, at which the opening on the top surface 4*a* side of the substrate is sealed by the first sealing plate 6. As shown in FIG. 6, the cross-sectional shape of this first merged fluid channel 28 in a direction perpendicular to the longitudinal direction makes a semicircular shape in which the portion of an arc shape faces the back surface 4*b* side of the substrate 4. The depth of the first merged fluid channel 28 in the thickness direction of the substrate 4 is larger than the depth of the first inlet path 22 in the same direction, and the width of the first merged fluid channel 28 in a direction perpendicular to the longitudinal direction of the first merged fluid channel 28, which is a lateral direction of the substrate 4, is larger than the width of the first inlet path 22 in the direction perpendicular to the longitudinal direction of the first inlet path 22, which is a lateral direction of the substrate 4.

The flow direction altering portion 30 (refer to FIG. 3) is connected to the downstream side of the first merged fluid channel 28, and is a portion for changing the flow direction of the mixed fluid so that this mixed fluid flowing through the first merged fluid channel 28 turns from the top surface 4*a* side of the substrate 4 to the back surface 4*b* side. In addition, the flow direction altering portion 30 is configured from the second hole 18, and portions of the second portion 10*b* of the first groove 10 at which the opening on the top surface 4*a* side of the substrate 4 is sealed by the first sealing plate 6 and of the third groove 14 at which the opening on the back surface 4*b* side of the substrate 4 is sealed by the second sealing plate 8 that are in communication via the second hole 18. The cross-sectional shape of the flow direction altering portion 30 in a direction perpendicular to the extending direction of the flow channel 2 is configured similarly to the cross-sectional shape of the merging portion 26 in the same direction.

Figure 7:
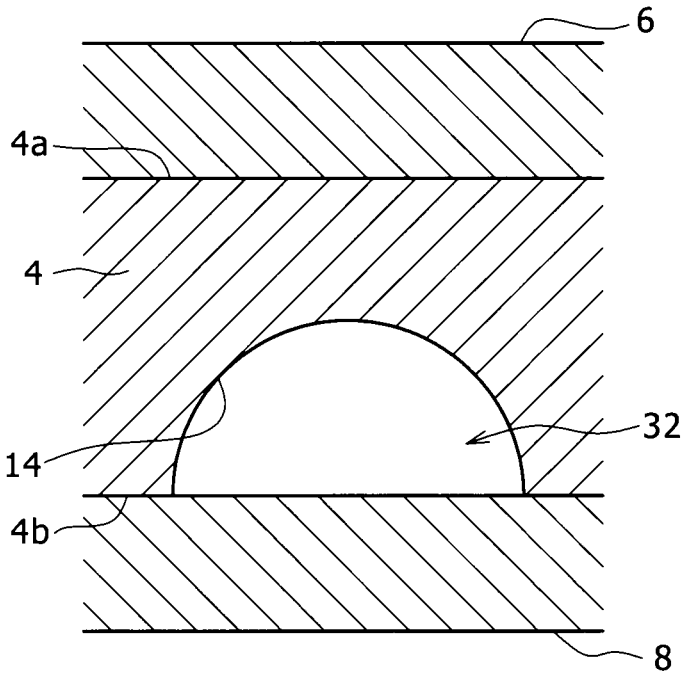
FIG. 7 is a cross-sectional view along the line VII-VII of the flow channel structure shown in FIG. 1.

The second merged fluid channel 32 (refer to FIG. 3) is a portion for changing the flow direction of the mixed fluid to flow to the downstream side so that this mixed fluid flowing from the first merged fluid channel 28 through the flow direction altering portion 30 flows along the back surface 4*b* of the substrate 4. This second merged fluid channel 32 is configured from a portion of the third groove 14, at which the opening on the back surface 4*b* side of the substrate 4 is sealed by the second sealing plate 8, the portion extending toward an opposite side than the second groove 12 side relative to the second hole 18. As shown in FIG. 7, the cross-sectional shape of this second merged fluid channel 32 in a direction perpendicular to the longitudinal direction makes a semicircular shape in which the portion of an arc shape faces the top surface 4*a* side of the substrate 4. The depth of the second merged fluid channel 32 in the thickness direction of the substrate 4 is equal to the depth of the first merged fluid channel 28 in the same direction. In addition, the width of the second merged fluid channel 32 in a direction perpendicular to the longitudinal direction of the second merged fluid channel 32, which is a lateral direction of the substrate 4, is equal to the width of the first merged fluid channel 28 in the direction perpendicular to this longitudinal direction that is a lateral direction of the substrate 4. Furthermore, the second merged fluid channel 32 is disposed so that a central position in the width direction thereof matches the central position in the width direction of the first merged fluid channel 28 and the central position in the width direction of the second inlet path 24.

Next, processes when the first fluid and the second fluid are mixed with each other by flowing through each of the flow channels 2 of the flow channel structure according to the present embodiment will be explained.

First, the first fluid is introduced into the first inlet path 22 of each of the flow channels 2, and the second fluid is introduced into the second inlet path 24 of each of the flow channels 2. The first fluid thus introduced into each of the first inlet paths 22 flows to the downstream side along the top surface 4*a* of the substrate 4 and flows into each of the merging portions 26, and the second fluid thus introduced into each of the second inlet paths 24 flows to the downstream side along the back surface 4*b* of the substrate 4 and flows into each of the merging portions 26. The first fluid having flowed into each of the merging portions 26 flows to the downstream side while slightly moving toward the back surface 4*b* side of the substrate 4, and the second fluid having flowed into each of the merging portions 26 flows to the downstream side while slightly moving toward the top surface 4*a* side of the substrate 4. Due to this, the first fluid and the second fluid merge while impinging on each other in the thickness direction of the substrate 4 in each of the merging portions 26, as a result of which, the first fluid and the second fluid are mixed together.

The mixed fluid of the first fluid and the second fluid thus merged in each of the merging portions 26 flows through each of the first merged fluid channels 28 to the downstream side along the top surface 4*a* of the substrate 4. Subsequently, this mixed fluid flows from each of the first merged fluid channels 28 to each of the flow direction altering portions 30, and flows from a top surface 4*a* side of the substrate 4 towards a back surface 4*b* side thereof. More specifically, the mixed fluid flows from each of the first merged fluid channels 28 into each of the flow direction altering portions 30, whereby the flow direction thereof suddenly changes from a direction following the top surface 4*a* of the substrate 4 to the thickness direction of the substrate 4. As a result thereof, disturbance arises in the flow of the mixed fluid, whereby mixing of the mixed fluid is promoted.

Then, the mixed fluid having flowed through each of the flow direction altering portions 30 from the top surface 4*a* side of the substrate 4 towards the back surface 4*b* side flows from this flow direction altering portion 30 into each of the second merged fluid channels 32, and flows along the back surface 4*b* of substrate 4. More specifically, the mixed fluid flows from each of the flow direction altering portions 30 into each of the second merged fluid channels 32, whereby the flow direction thereof suddenly changes from the thickness direction of the substrate 4 to a direction along the back surface 4*b* of the substrate 4. As a result thereof, disturbance further arises in the flow of the mixed fluid, whereby mixing of the mixed fluid is further promoted.

Mixing between the first fluid and the second fluid flowing through each of the flow channels 2 is performed by configuring in the above way.

As explained in the foregoing, with the flow channel structure according to the present embodiment, in the process of the mixed fluid reaching the second merged fluid channels 32 from the first merged fluid channels 28 through the flow direction altering portion 30 in each of the flow channels 2, the flow direction of this mixed fluid suddenly changes from a direction along the top surface 4*a* of the substrate 4 to the thickness direction of the substrate 4, and then further changes suddenly from the thickness direction of the substrate 4 to a direction along the back surface 4*b* of the substrate 4. Due to this, disturbance arises in the flow of the mixed fluid in this process, as a result of which, mixing of the mixed fluid can be promoted. Then, in the present embodiment, since mixing of this mixed fluid is promoted by causing the flow direction of the mixed fluid to suddenly change from a direction along the top surface 4*a* of the substrate 4 to the thickness direction of the substrate 4, and further to a direction along the back surface 4*b* of the substrate 4, in the portion of each of the flow channels 2 from the first merged fluid channel 28 to the second merged fluid channel 32 in this way, it is not necessary to attempt to promote mixing of the fluid by narrowing the channel diameter by a projection as in a conventional flow channel structure, and it is possible to avoid a considerable rise in pressure loss in each of the flow channels 2.

Furthermore, in the present embodiment, since the portion of each of the flow channels 2 from the first merged fluid channel 28 through the flow direction altering portion 30 to the second merged fluid channel 32 is formed in a curved shape in the thickness direction of the substrate 4, compared to a case of the portion from the first merged fluid channel through the flow direction altering portion to the second merged fluid channel being formed in a curved shape in the same surface of the substrate, it is possible to reduce the width occupied by this portion in a lateral direction of the substrate 4.

In addition, in the present embodiment, since the first inlet path 22 and the second inlet path 24 of each of the flow channels 2 extend in parallel to each other, compared to a case of the first inlet path and second inlet path extending in different directions from each other in a lateral direction of the substrate, it is possible to reduce the width in the flow channel structure occupied by the first inlet path 22 and the second inlet path 24 of each of the flow channels 2 in the lateral direction of the substrate 4.

Furthermore, in the present embodiment, since the first inlet path 22 of each of the flow channels 2 is disposed within the span of the width of the second inlet path 24, compared to a case of one among the two inlet paths being disposed so as to protrude in the width direction relative to the other one, it is possible to further reduce the width occupied by the two inlet paths 22, 24 in the lateral direction of the substrate 4.

Moreover, in the present embodiment, since the second merged fluid channel 32 of each of the flow channels 2 extends in parallel with the first merged fluid channel 28, compared to a case of the second merged fluid channel and the first merged fluid channel extending in a different direction from each other, it is possible to reduce the width in the flow channel structure occupied by the portion from the first merged fluid channel 28 to the second merged fluid channel 32 of each of the flow channels in the lateral direction of the substrate 4.

In addition, in the present embodiment, since the flow channel structure has a plurality of the flow channels 2, it is possible to merge the first fluid and second fluid in each of the plurality of flow channels 2 to perform the process of mixing these fluids, and thus the efficiency of the fluid mixing process for the flow channel structure overall can be improved. Moreover, in the present embodiment, the first inlet paths 22, second inlet paths 24, first merged fluid channels 28 and second merged fluid channels 32 of the flow channels 2 are disposed in parallel to each other, respectively; therefore, compared to a case of these channels being disposed so as to extend in different directions from each other, it is possible to reduce the intervals between each of the flow channels 2. As a result, in the present embodiment, the plurality of flow channels 2 can be densely arranged, even in a case of an increase in capacity of the flow channel structure being demanded; therefore, the flow channel structure can be made more compact, while being able to realize an increase in the capacity of the flow channel structure. Therefore, in the present embodiment, it is possible to make the flow channel structure more compact, while improving the efficiency in the fluid mixing process in the flow channel structure overall.

It should be noted that the embodiment presently disclosed should be considered as an illustrative example in all respects, and not to be limiting.

The scope of the present invention is not defined by the aforementioned explanation of the embodiment, but rather by the scope of the appended claims. Furthermore, all modifications with the equivalent spirit and within the scope of the appended claims are included in the present invention.

Figure 8:
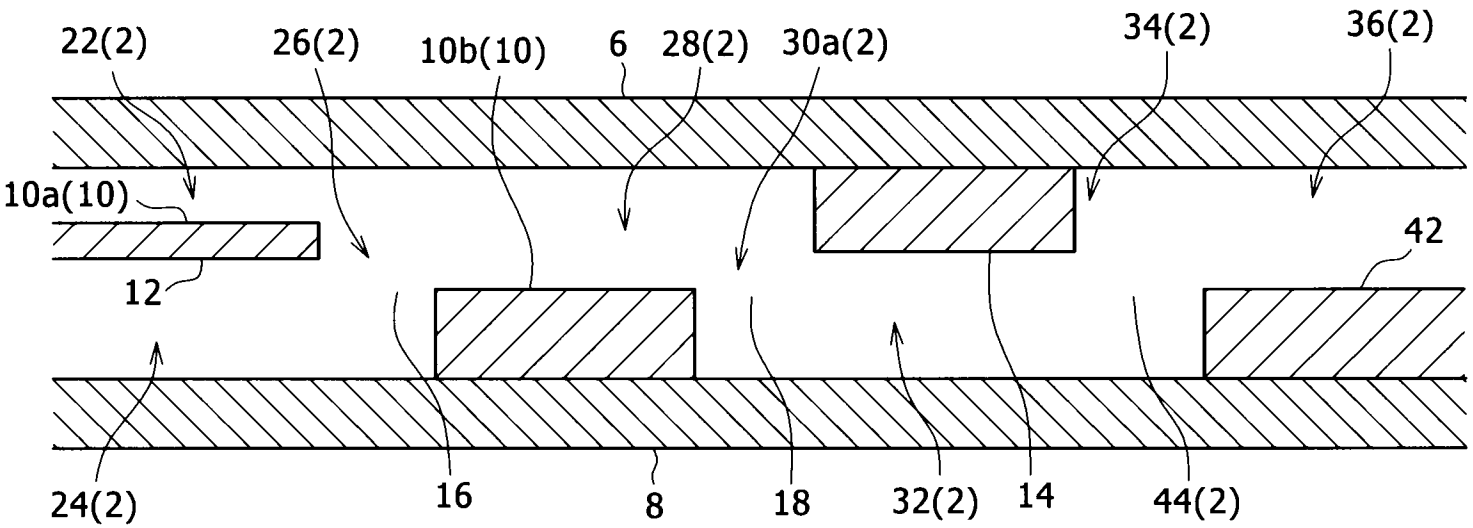
FIG. 8 is a cross-sectional view corresponding to FIG. 3, along the longitudinal direction of the flow channel of the flow channel structure according to a modified example of the embodiment of the present invention.

For example, each flow channel 2 may be configured so that a further change in the flow direction of the fluid is carried out at a downstream side of the second merged fluid channel 32, as in the modified example of the above-mentioned embodiment shown in FIG. 8.

More specifically, with the flow channel structure according to this modified example, each of the flow channels 2 has the first inlet path 22, the second inlet path 24, the merging portion 26, the first merged fluid channel 28, a first flow direction altering portion 30*a*, the second merged fluid channel 32, a second flow direction altering portion 34, and a third merged fluid channel 36. It should be noted that the first flow direction altering portion 30*a* is included in the concept of a flow direction altering portion according to the present invention, and is configured similarly to the flow direction altering portion 30 of the above-mentioned embodiment.

A plurality of fourth grooves 42 is formed in the top surface 4*a* of the substrate 4 configuring the flow channel structure by way of etching. Each of the fourth grooves 42 is disposed to be separated from an end of the second portion 10*b* of a corresponding first groove 10 that is on an opposite side to the first portion 10*a* in the longitudinal direction of this first groove 10, and extends in the same direction as this corresponding first groove 10. Each of the fourth grooves 42 is disposed so that a central position in the width direction thereof matches with that of the corresponding first groove 10. In addition, each of the fourth grooves 42 is disposed so as to be aligned in parallel with each other at even intervals, and each open to the top surface 4*a* of the substrate 4. The end of each of the fourth grooves 42 on a first groove 10 side thereof is disposed so as to overlap an end of the third groove 14 on an opposite side to the second groove 12 positioned on the back side of the fourth groove 42, when viewed from a direction perpendicular to the top surface 4*a* and back surface 4*b* of the substrate 4. In addition, the fourth groove 42 has the same cross-sectional shape as the second portion 10*b* of the first groove 10 in a cross section perpendicular to the longitudinal direction of the fourth groove 42. The first sealing plate 6 is joined to the top surface 4*a* of the substrate 4 so as to seal the openings of each of the first grooves 10 and each of these fourth grooves 42 on the top surface 4*a* side of the substrate 4.

In addition, a plurality of third holes 44 is formed in the substrate 4. Each of the third holes 44 is formed at a location on the substrate 4 at which an end of each of the fourth grooves 42 on a first groove 10 side thereof is positioned, respectively. Each of the third holes 44 penetrates the substrate 4 from the top surface 4*a* to the back surface 4*b* in the thickness direction of the substrate 4 to allow the end of each of the fourth grooves 42 on the first groove 10 side thereof and the end of the third groove 14 on an opposite side to the second groove 12 located at the back side of the fourth grooves 42 to be in communication. When the third groove 14 and the fourth groove 42 are each formed by etching, the overlapped ends thereof connect in the thickness direction of the substrate 4 due to the sum of the depths of the third groove 14 and the fourth groove 42 in communication via the third hole 44 being greater than the thickness of the substrate 4, whereby each of these third holes 44 is formed.

The second flow direction altering portion 34 of each of the flow channels 2 is connected to the downstream side of the second merged fluid channel 32, and is a portion for changing the flow direction of the mixed fluid so that this mixed fluid flowing through the second merged fluid channel 32 turns from the back surface 4*b* side of the substrate 4 to the top surface 4*a* side. This second flow direction altering portion 34 is configured from the third hole 44, and portions of the fourth groove 42 at which the opening on the top surface 4*a* side of the substrate 4 is sealed by the first sealing plate 6 and of the third groove 14 at which the opening on the back surface 4*b* side of the substrate 4 is sealed by the second sealing plate 8 that are in communication via the third hole 44. The cross-sectional shape of the second flow direction altering portion 34 in a direction perpendicular to the extending direction of the flow channel 2 is configured similarly to the cross-sectional shape of the first flow direction altering portion 30*a* in the same direction.

The third merged fluid channel 36 of each of the flow channels 2 is a portion for changing the flow direction of the mixed fluid to flow to a downstream side so that this mixed fluid flowing from the second merged fluid channel 32 through the second flow direction altering portion 34 flows along the top surface 4*a* of the substrate 4. This third merged fluid channel 36 is configured from a portion of the fourth groove 42 at which the opening on the top surface 4*a* side of the substrate 4 is sealed by the first sealing plate 6, the portion extending to an opposite side than the first groove 10 relative to the third hole 44. The third merged fluid channel 36 is disposed so that a central position in the width direction thereof matches the central position in the width direction of the first inlet path 22, the second inlet path 24, the first merged fluid channel 28, and the second merged fluid channel 32. Configurations of this third merged fluid channel 36 other than this are similar to the configurations of the first merged fluid channel 28.

Then, with the flow channel structure according to this modified example, the mixed fluid of the first fluid and the second fluid flows from each of the first merged fluid channels 28 of the respective flow channels 2 through the respective first flow direction altering portions 30 to the respective second merged fluid channels 32 while changing the flow direction thereof, after which the mixed fluid flows into the respective second flow direction altering portions 34. The mixed fluid thereby flows from the back surface 4*b* side of the substrate 4 towards the top surface 4*a* side thereof. More specifically, the mixed fluid flows from each of the second merged fluid channels 32 into each of the second flow direction altering portions 34, whereby the flow direction thereof suddenly changes from a direction following the back surface 4*b* of the substrate 4 to the thickness direction of the substrate 4. As a result thereof, disturbance arises in the flow of the mixed fluid, whereby mixing of the mixed fluid is promoted.

Then, the mixed fluid having flowed through each of the second flow direction altering portions 34 from the back surface 4*b* side of the substrate 4 towards the top surface 4*a* side flows from this second flow direction altering portion 34 into each of the third merged fluid channels 36, and flows along the top surface 4*a* of substrate 4. More specifically, the mixed fluid flows from each of the second flow direction altering portions 34 into each of the third merged fluid channels 36, whereby the flow direction thereof suddenly changes from the thickness direction of the substrate 4 to a direction along the top surface 4*a* of the substrate 4. As a result thereof, further disturbance arises in the flow of the mixed fluid, whereby mixing of the mixed fluid is further promoted.

It should be noted that a channel having a similar structure as the first flow direction altering portion 30*a* and the second merged fluid channel 32 may be further connected to the downstream side of the third merged fluid channel 36 of each of the flow channels 2 according to the present modified example, and a channel constituting part having a similar structure as the first flow direction altering portion 30*a* and the second merged fluid channel 32, and a channel constituting part having a similar structure as the second flow direction altering portion 34 and the third merged fluid channel 36 may be provided to the downstream side of this third merged fluid channel 36 so as to be continuous by any number of times repeating this sequence. The mixing of the mixed fluid is further promoted with an increase in the number of times repeated; therefore, by setting the number of times repeated to certain number of times, it is possible to adjust the extent of mixing of the mixed fluid.

Also, the flow channel structure may have only one of the flow channels 2.

In addition, the first portion of the first groove and the second groove may be formed so as to extend in different directions from each other when viewed from a direction perpendicular to the top surface of the substrate, and disposed so that portions of the first groove and second groove that are in communication via the first hole overlap when viewed from a direction perpendicular to the substrate.

Furthermore, the second portion of the first groove and the third groove may be formed so as to extend in different directions from each other when viewed from a direction perpendicular to the top surface of the substrate, and disposed so that portions of the second portion of the first groove and the third groove that are in communication via the second hole overlap when viewed from a direction perpendicular to the substrate.

Moreover, a channel extending in a direction different from the direction of the first inlet path 22, or a channel having various shapes such as bent or curved shapes may be connected to the upstream side of this first inlet path 22. Additionally, a similar channel may be connected to the upstream side of the second inlet path 24.

Furthermore, a channel extending in a direction different from the direction of the downstream most portion of the flow channel 2, or a channel having various shapes such as bent or curved shapes may be connected to this downstream most portion.

In addition, the first inlet path and the second inlet path may have equal channel widths to each other by the first portion of the first groove and the second groove being formed so as to have equal widths to each other. Moreover, the first inlet path may have a larger channel width than the second inlet path by the first portion of the first groove being formed so as to have a larger width than the second groove.

Additionally, for the first inlet path (first portion of the first groove) and the second inlet path (second inlet groove), the central positions in the width direction of these may be made so as not to match, and one of these may be provided so as to protrude in the width direction relative to the other one, when viewed from a direction perpendicular to the top surface of the substrate.

Furthermore, each groove and each hole configuring the flow channel is not limited to being formed in the substrate by etching. For example, these grooves and holes may be formed in the substrate by a machining process or the like.

In addition, the cross-sectional shape of each part configuring the flow channels and each groove and each hole configuring these may be various shapes other than those described above.

What is claimed is:

1. A flow channel structure having a flow channel for causing a first fluid and a second fluid to flow so as to mix together inside thereof, the flow channel structure comprising:

a substrate having a top surface and a back surface that faces an opposite direction to said top surface;

a first sealing plate joined to said top surface of said substrate; and a second sealing plate joined to said back surface of said substrate, wherein said substrate includes a first groove extending in a specific direction in said top surface of said substrate, a second groove extending in said specific direction in said back surface of said substrate, an end of said second groove overlapping said first groove when viewed from a direction perpendicular to said top surface of said substrate, a third groove extending in said specific direction in said back surface of said substrate, an end of said third groove overlapping said first groove when viewed from said direction perpendicular to said top surface of said substrate, said end of said third groove being separated from said end of said second groove in said specific direction within said substrate such that a portion of said substrate is disposed between said end of said second groove and said end of said third groove, and such that an area of overlap between said second groove and said first groove is distinct from an area of overlap between said third groove and said first groove, a first hole, which penetrates said substrate in said area of overlap between said second groove and said first groove from said top surface to said back surface such that said second groove communicates with said first groove positioned on a top side of said second groove, and a second hole, which penetrates said substrate in said area of overlap between said third groove and said first groove from said top surface to said back surface such that said third groove communicates with said first groove positioned on a top side of said third groove, wherein said first sealing plate is joined to said top surface of said substrate so as to seal an opening of said first groove on a top surface side thereof, wherein said second sealing plate is joined to said back surface of said substrate so as to seal an opening of said second groove on a back surface side thereof and an opening of said third groove on a back surface side thereof, and wherein the flow channel is configured by a portion of said first groove positioned on an opposite side relative to said first hole than a side on which said second hole is formed, the flow channel including:

a first inlet path into which the first fluid is introduced, a second inlet path into which the second fluid is introduced, configured by a portion of said second groove other than a portion in which said first hole is formed, a merging portion configured by said first hole and portions of said first groove and said second groove that are in communication via said first hole, the merging portion merging the first fluid flowing through said first inlet path and the second fluid flowing through said second inlet path in a thickness direction of said substrate, a first merged fluid channel that is configured by a portion of said first groove positioned between said first hole and said second hole such that said first merged fluid channel overlaps said portion of said substrate that is disposed between said end of said second groove and said end of said third groove, and such that both the first fluid and the second fluid merged in said merging portion flow along said top surface of said substrate through said first merged fluid channel, a flow direction altering portion that is configured by said second hole and portions of said first groove and said third groove that are in communication via said second hole, the flow direction altering portion causing a flow direction of the fluid flowing through said first merged fluid channel to change from a top surface side of said substrate towards a back surface side thereof, and a second merged fluid channel that is configured by a portion of said third groove extending to an opposite side relative to said second hole than a side on which said second groove is formed, the second merged fluid channel changing the flow direction of the fluid to flow to a downstream side so that the fluid flowing from said first merged fluid channel through said flow direction altering portion flows along said back surface of said substrate.

2. The flow channel structure according to claim 1, wherein said second groove extends in parallel with said first groove.

3. The flow channel structure according to claim 2, wherein one of a portion of said first groove which configures said first inlet path and the portion of said second groove configuring said second inlet path is provided within a span of a width of the other one thereof, when viewed from the direction perpendicular to said top surface of said substrate.

4. The flow channel structure according to claim 1, wherein said third groove extends in parallel with said first groove.

5. The flow channel structure according to claim 1, further comprising a plurality of the flow channels, wherein said first grooves, respectively, which configure said first inlet path and said first merged fluid channel of each of the plurality of the flow channels, are disposed to be aligned in parallel with each other at said top surface of said substrate, wherein said second grooves, respectively, which configure said second inlet path of each of the flow channels, are disposed to be aligned in parallel with each other at said back surface of said substrate, and wherein said third grooves, respectively, which configure said second merged fluid channel of each of the flow channels, are disposed to be aligned in parallel with each other at said back surface of said substrate.

* * * * *